US007744749B2

(12) United States Patent
Martinie et al.

(10) Patent No.: US 7,744,749 B2
(45) Date of Patent: Jun. 29, 2010

(54) DIESEL OIL DESULFURIZATION BY OXIDATION AND EXTRACTION

(75) Inventors: Gary M. Martinie, Dhahran (SA); Farhan M. Al-Shahrani, Al-Rabwah Dhahran (SA); Bashir O. Dabbousi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 401 days.

(21) Appl. No.: 11/222,729

(22) Filed: Sep. 8, 2005

(65) Prior Publication Data

US 2007/0051667 A1 Mar. 8, 2007

(51) Int. Cl.
*C10G 45/04* (2006.01)

(52) U.S. Cl. ..... 208/212; 208/208 R; 208/236; 208/240; 208/242; 208/196; 585/857; 585/864

(58) Field of Classification Search ..... 208/212, 208/208 R, 236, 240, 242, 196; 585/857, 585/864

See application file for complete search history.

(56) References Cited

U.S. PATENT DOCUMENTS

| | | | | |
|---|---|---|---|---|
| 2,253,308 | A | 8/1941 | Rosen | |
| 2,593,761 | A | 4/1952 | Johnstone | |
| 2,671,049 | A | 3/1954 | Brown | |
| 2,697,682 | A | 12/1954 | Porter | |
| 2,834,717 | A | 5/1958 | Shiah | |
| 3,284,342 | A | 11/1966 | Nathan et al. | |
| 3,341,448 | A | 9/1967 | Ford et al. | |
| 3,565,793 | A | 2/1971 | Herbstman et al. | |
| 3,595,778 | A | 7/1971 | Smetana et al. | |
| 3,719,589 | A | 3/1973 | Herbstman et al. | |
| 3,816,301 | A | 6/1974 | Sorgenti | |
| 3,945,914 | A | 3/1976 | Yoo et al. | |
| 4,088,569 | A * | 5/1978 | Douglas | 208/206 |
| 4,562,276 | A | 12/1985 | Venturello et al. | |
| 4,595,671 | A | 6/1986 | Venturello et al. | |
| 4,607,113 | A | 8/1986 | Shum et al. | |
| 4,731,482 | A | 3/1988 | Venturello et al. | |
| 4,772,731 | A | 9/1988 | Shum et al. | |
| 5,017,280 | A | 5/1991 | Paris-Marcano | |
| 5,087,350 | A | 2/1992 | Paris-Marcano | |
| 5,274,140 | A | 12/1993 | Venturello et al. | |
| 5,310,479 | A | 5/1994 | Audeh | |
| 5,324,849 | A | 6/1994 | Bonsignore et al. | |
| 5,547,563 | A | 8/1996 | Stowe | |
| 5,780,655 | A | 7/1998 | Shum | |
| 5,847,120 | A | 12/1998 | Collins et al. | |
| 5,948,242 | A | 9/1999 | Ohsol et al. | |
| 5,958,224 | A | 9/1999 | Ho et al. | 208/240 |

(Continued)

FOREIGN PATENT DOCUMENTS

WO WO 00/15734 3/2000

OTHER PUBLICATIONS

International Search Report, Feb. 15, 2008, PCT/US06/29574.

(Continued)

*Primary Examiner*—Tam M Nguyen
(74) *Attorney, Agent, or Firm*—Abelman, Frayne & Schwab

(57) ABSTRACT

The reduction in the sulfur-containing content of diesel fuel is achieved by oxidation in the presence of a catalyst followed by a liquid-liquid countercurrent extraction.

30 Claims, 1 Drawing Sheet

U.S. PATENT DOCUMENTS

| | | | | |
|---|---|---|---|---|
| 5,961,820 | A | 10/1999 | Jeanblanc et al. | 208/231 |
| 5,985,137 | A | 11/1999 | Ohsol et al. | |
| 6,054,580 | A | 4/2000 | Collins et al. | |
| 6,160,193 | A | 12/2000 | Gore | |
| 6,171,478 | B1 | 1/2001 | Cabrera et al. | |
| 6,274,785 | B1 | 8/2001 | Gore | |
| 6,277,271 | B1 * | 8/2001 | Kocal | 208/212 |
| 6,368,495 | B1 | 4/2002 | Kocal et al. | |
| 6,402,938 | B1 | 6/2002 | Moore et al. | |
| 6,402,939 | B1 * | 6/2002 | Yen et al. | 208/196 |
| 6,402,940 | B1 | 6/2002 | Rappas | |
| 6,406,616 | B1 | 6/2002 | Rappas et al. | |
| 6,485,633 | B2 | 11/2002 | Wismann et al. | 208/307 |
| 6,500,219 | B1 | 12/2002 | Gunnerman | |
| 6,503,471 | B1 | 1/2003 | Han et al. | |
| 6,544,409 | B2 | 4/2003 | De Souza | 208/208 |
| 6,565,741 | B2 | 5/2003 | Wismann et al. | 208/208 |
| 6,596,914 | B2 | 7/2003 | Gore et al. | 585/833 |
| 6,638,419 | B1 | 10/2003 | Da Silva et al. | 208/208 R |
| 6,652,992 | B1 | 11/2003 | Gunnerman | |
| 6,673,236 | B2 | 1/2004 | Stanciulescu et al. | |
| 7,314,545 | B2 * | 1/2008 | Karas et al. | 208/208 R |
| 2002/0029997 | A1 | 3/2002 | Rappas et al. | 208/240 |
| 2002/0035306 | A1 | 3/2002 | Gore et al. | 585/833 |
| 2002/0043482 | A1 | 4/2002 | Wismann et al. | 208/208 |
| 2002/0130062 | A1 | 9/2002 | Wismann et al. | 208/189 |
| 2002/0144932 | A1 | 10/2002 | Gong et al. | 208/212 |
| 2002/0148754 | A1 | 10/2002 | Gong et al. | 208/3 |
| 2002/0148756 | A1 * | 10/2002 | Morris et al. | 208/212 |
| 2002/0189975 | A1 | 12/2002 | De Souza | 208/208 |
| 2003/0014911 | A1 | 1/2003 | Gunnerman | 44/622 |
| 2003/0051988 | A1 | 3/2003 | Gunnerman et al. | 204/157.6 |
| 2003/0075483 | A1 | 4/2003 | Stanciulescu et al. | 208/208 |
| 2003/0102252 | A1 | 6/2003 | Rabion et al. | |
| 2003/0183555 | A1 | 10/2003 | Corma Canos et al. | 208/208 |
| 2004/0007501 | A1 | 1/2004 | Sughrue et al. | 208/208 |
| 2004/0007502 | A1 | 1/2004 | Wismann et al. | 208/208 |
| 2004/0035753 | A1 | 2/2004 | Cullen | 208/254 |
| 2004/0074812 | A1 | 4/2004 | Cullen | 208/208 |
| 2004/0079680 | A1 | 4/2004 | Gunnerman | 208/208 |
| 2004/0108252 | A1 | 6/2004 | De Souza | 208/208 |
| 2004/0118750 | A1 | 6/2004 | Gong et al. | 208/221 |
| 2004/0140247 | A1 | 7/2004 | Canos et al. | 208/196 |
| 2004/0154959 | A1 | 8/2004 | Schoebrechts et al. | 208/196 |
| 2004/0159583 | A1 | 8/2004 | Mesters et al. | |
| 2004/0170553 | A1 * | 9/2004 | Axon et al. | 423/392 |
| 2004/0178121 | A1 | 9/2004 | Leyshon et al. | 208/196 |
| 2004/0178122 | A1 | 9/2004 | Karas et al. | 208/196 |
| 2004/0200759 | A1 | 10/2004 | Cullen | 208/211 |
| 2004/0222131 | A1 | 11/2004 | Cullen | |
| 2007/0051667 | A1 | 3/2007 | Martinie et al. | |

OTHER PUBLICATIONS

Avidan et al., "Sulphco-Desulfurization Via Selective Oxidation—Pilot Plant Results and Commercialization Plans," National Petrochemical & Refiners Association, Presented at the NPRA 2001 Annual Meeting, Mar. 18-20, 2001.

Baker et al., "Hydroperoxide Oxidations Catalyzed by Metals. IV. Molybdenum Hexacarbonyl Catalyzed Epoxidation of 1-Octene," J. Org. Chem., vol. 38, No. 6, 1973, p. 1145-1148.

Ballistreri et al., "Application of the Thianthrene 5-Oxide Mechanistic Probe to Peroxometal Complexes," J. Am. Chem. Soc. 1991, 133, p. 6209-6212.

Ballistreri et al., Rates and Mechanism of the Stoichiometri Oxidations of Organic Sulphides to Sulphoxides with the Peroxomolybdenum Complex $MoO(O_2)_2HMPT$, Journal of Molecular Catalysis, 50 (1989) p. 39-44.

Ballistreri et al., "Reactivity of Peroxopolyoxo Complexes. Oxidation of Thioethers, Alkenes, and Sulfoxides by Tetrahexylammonium Tetrakis(diperoxomolybdo)phosphate," j. Org. Chem. 1992, 57, p. 7074-7077.

Berkessel, Albrecht, "Biomimetic Oxidation of Organic Substrates with Hydrogen Peroxide," Contribution, Institut fur Organische Chemie der Universitat zu Koln, Griemstr. 4, D-50939 Koln, Germay; TCI Mail 109, 3-13 (2001).

Bianchini et al., "Liquid-Biphase Hydrogenolysis of Benzo(*b*)thiophene by Rhodium Catalysis," J. Am Chem. Soc., 1997, 119, p. 4945-4954.

Bonchio et al., "The Relative Reactivity of Thioethers and Sulfoxides toward Oxygen Transfer Reagents: The Oxidation of Thianthrene 5-Oxide and Related Compounds by $MoO_5HMPT$," J. Org. Chem., 1995, 60, 4475-4480.

Bora et al., "Peroxometal-mediated environmentally favorable route to brominating agents and protocols for bromination of organics," Pure Appl. Chem., vol. 73, No. 1 pp. 93-102, 2001.

Botrel et al., "An experimental and theoretical investigation of the regioselective cleavage of aromatic sulfones," New. J. Chem., 2000, 24, p. 815-820.

Brauer et al., "Formation of singlet molecular oxygen by the Radziszewski reaction between acetonitrile and hydrogen peroxide in the absence and presence of ketones," J. Chem. Soc., Perkin Trans. 2, 2002, p. 1288-1295.

Campos-Martin et al., "Highly efficient deep desulfurization of fuels by chemical oxidation," Green Chem., 2004, 6, p. 557-562.

Collins et al., "Oxidative desulphurization of oils via hydrogen peroxide and heteropolyanion catalysis," Journal of Molecular Catalysis A: Chemical 117, 1997, p. 397-403.

D'Alessandro et al., "Oxidation of dibenzothiophene by hydrogen peroxide or monopersulfate and metal-sulfophtalocyanine catalysts: an easy access to biphenylsultone or 2-(2'-hydroxybiphenyl)sulfonate under mild conditions," New J. Chem., 2003, 27, p. 989-993.

Dishun et al., "A Review of Desulfurization of Light Oil Based on Selective Oxidation," http://www.chemistrymag.org/cji/2004/063017re.htm, Mar. 21, 2004, vol. 6, No. 3, p. 17.

Gosling et al., "The Role of Oxidative Desulfurization in an Effective ULSD Strategy," National Petrochemical & Refiners Association, Annual Meeting, Mar. 21-23, 2004, AM-04-48.

Herbstman et al., "Oxidative Desulfurization of Residual Oils," Symposium on Upgrading of Synthetic Crudes Presented Before the Division of Petroleum Chemistry, Inc., American Chemical Society, Kansas City Meeting, Sep. 12-17, 1982; A.m. Chem. Soc., Div. Pet. Chem. (1982), 27(4), pp. 826-836.

Hu et al., "Catalysis by Heteropoly Compounds XXII. Reactions of Esters and Esterification Catalyzed by Heteropolyacids in a Homogeneous Liquid Phase—Effects of the Cnetral Atom of Heteropolyanions Having Tungsten as the Addenda Atom," Journal of Catalysis 143, 1993, p. 437-448.

Ishihara et al., "Oxidative desulfurization and denitrogenation of a light gas oil using an oxidation/adsorption continuous flow process," Applied Catalysis A: General 279, 2005, p. 279-287.

Laus, Gerhard, "Kinetics of acetonitrile-assisted oxidation of tertiary amines by hydrogen peroxide," J. Chem. Soc., Perkin Trans. 2, 2001, p. 864-868.

Levy et al., "Unipure's Oxidative Desulfurization Process Creates New Market Opportunities for Supply of Ultra-Low Sulfur Fuels," UniPure Corporation, Prepared for Presentation at AIChE 2002 Spring Meeting, New Orleans, Mar. 13, 2002, Session on Non-Conventional Technology for Desulfurization, Paper No. 36c.

Ligtenbarg, Alette, *Vanadium and Iron Complexes for Catalytic Oxidation*; Disertaion, University of Groningen, 2001.

Liotta et al., "Production of Ultra-Low Sulfur Fuels by Selective Hydroperoxide Oxidation," National Petrochemical & Refiners Assocation, Annual Meeting, Mar. 23-25, 2003, AM-03-23.

Martinie et al., "Investigation of the Wet Oxidation Efficiencies of Perchloric Acid Mixtures for Various Organic Substances and the Identities of Residual Matter," Analytical Chemistry, vol. 48, No. 1, Jan. 1976, p. 70-74.

Murata et al., "A Novel Oxidative Desulfurization System for Diesel Fuels with Molecular Oxygen in the Presence of Cobalt Catalysts and Aldehydes," Energy & Fuels 2004, 18, p. 116-121.

Nizova et al., "Catalytic oxidation of methane to methyl hydroperoxide and other oxygenates under mild conditions," Chem. Commun., 1997, p. 397-398.

Oh et al., "The Remote Activation of Chemical Bonds via Metal Coordination," Advanced Synthesis & Catalysis; vol. 345 Issue 9-10, 2003, pp. 1053-1060.

Raja et al., "New catalysts for the aerobic selective oxidation of hydrocarbons: Mn(III)- and Co(III)-containing molecular sieves for the epoxidation of alkenes," Chem. Commun., 1999, p. 829-830.

Ramirez-Verduzco et al., "Desulfurization of Middle Distillates by Oxidation and Extraction Process," Petroleum Science and Technology, vol. 22, Nos. 1 & 2, pp. 129-139, 2004.

Research & Development Update, "Catalyst Helps Destroy Toxic Pollutants," CEP, www.cepmagazine.org, Nov. 2003, p. 15-17.

Schilt et al., "Determination of Acetates and Acetyl Groups by Digestion of Samples in Perchloric Acid Followed by Either Nuclear Magnetic Resonance Spectrometry or Distillation and Potentiometric Titration," Analytical Chemistry, vol. 48, No. 2, Feb. 1978, p. 447-450.

Shiraishi et al., "A Deep Desulfurization Process for Light Oil by Photosensitized Oxidation Using a Triplet Photosensitizer and Hydrogen Peroxide in an Oil/Water Two-Phase Liquid-Liquid Extraction System," Ind. Eng. Chem. Res., 1999, 38, p. 1589-1595.

Shiraishi et al., "Desulfurization of Vacuum Gas Oil Based on Chemical Oxidation Followed by Liquid-Liquid Extraction," Energy & Fuels 2004, 18, p. 37-40.

Shiraishi et al., "Photochemical Production of Biphenyls from Oxidized Sulfur Compounds Obtained by Oxidative Desulfurization of Light Oils," Energy & Fuels 2003, 17, p. 95-100.

Taube, Fabian, "Characterization of Aqueous Peroxomolybdates with Catalytic Applicability," Department of Chemistry, Inorganic Chemistry, Umea University, Umea, Sweden, Dec. 12, 2002.

Te et al., "Oxidation reactivities of dibenzothiophenes in poloxometalate/$H_2O_2$ and formic acid/$H_2O_2$ systems," Applied Catalysis A: General 219, 2001, p. 267-280.

Venturello et al., "A new peroxotungsten heteropoly anlon with special oxidizing properties: synthesis and structure of tetrahexylammonium tetra(diperoxotungsto)phosphate (3-)," abstract from J. Mol. Catal., 32(1), 107-10, 1985 (Chem. Abst, 104,27804z(1986)).

Venturello et al., "A New, Effective Catalytic System for Epoxidation of Olefins by Hydrogen Peroxide under Phase-Transfer Conditions," J. Org. Chem., 1983, 48, p. 3831-3833.

Yazu et al., "Tungstophosphoric Acid-catalyzed Oxidative Desulfurization of Light Oil with Hydrogen Peroxide in a Light Oil/Acetic Acid Biphasic System," Chemistry Letters, vol. 32, No. 10, 2003, p. 920-921.

Yu et al., "Oxidative Desulfurization of Diesel Fuels with Hydrogen Peroxide in the Presence of Activated Carbon and Formic Acid," Energy & Fuels, 2005, 19, p. 447-452.

Zapata et al., "Catalyst screening for oxidative desulfurization using hydrogen peroxide," Catalysis Today 106, 2005, p. 219-221.

* cited by examiner

DIESEL OIL DESULFURIZATION BY OXIDATION AND EXTRACTION

BACKGROUND OF THE INVENTION

This invention is directed to the removal of sulfur-containing compounds from diesel fuel and, more particularly, their removal by a combination of oxidation and extraction steps.

PRIOR ART

The removal of sulfur compounds from petroleum streams has been of considerable importance in the past and is even more so today due to environmental considerations. Gas effluent from the combustion of organic materials, such as coal, almost always contain sulfur compounds and sulfur removal processes have concentrated on removing hydrogen sulfide since it has been considered a significant health hazard and also because it is corrosive, particularly when water is present. With increasing emphasis on eliminating or minimizing sulfur discharge to the atmosphere, attention is turning to the removal of other sulfur compounds from gas streams.

The removal of sulfur compounds and particularly chemically-combined sulfur, such as organosulfur compounds, from feedstreams is highly desirable to meet environmental concerns and to prevent potential catalyst deactivation as well as equipment corrosion.

Typically, hydrocarbon products contain various amounts of sulfur compounds in the form of, for example, chemically-combined sulfur, such as inorganically combined sulfur and organically combined sulfur, i.e., organosulfur compounds.

The presence of organosulfur compounds in hydrocarbon streams results naturally, as well as from the introduction of organosulfur compounds, into the hydrogen streams during conventional processes for producing and treating hydrocarbon products.

As previously indicated, if chemically-combined sulfur, such as organosulfur compounds, are not removed from the hydrocarbon streams, the presence of organosulfur compounds in the resultant hydrocarbon products, including natural gas, paraffins, olefins and aromatics, particularly gasoline, diesel or other fuels, can cause corrosion of processing equipment and engine parts, as well as other deleterious effects, particularly when water is present.

Oxidative desulfurization research for diesel and other oil streams has been ongoing for over 100 years. The following table summarizes patents granted from 1941 to 1976 addressed to oxidative desulfurization.

| Patent No. | Inventor | Assignee | Title |
|---|---|---|---|
| 2,253,308 Aug. 19, 1941 | Rosen, Raphael | Standard Catalytic | Desulfurization of Hydrocarbons |
| 2,697,682 Dec. 21, 1954 | Porter, Fredrich | Anglo-Iranian Oil | Catalytic Desulfurization of Petroleum Hydrocarbons |
| 2,671,049 Mar. 2, 1954 | Brown, Russell | Standard Oil | Odor Improvement of Petroleum Oils |
| 2,834,717 May 13, 1958 | Shiah, Chyn | | Process of Desulfurizing Hydrocarbons with a Boron Fluoride |
| 3,284,342 Nov. 8, 1966 | Nathan, Wilfred | British Petroleum | Desulfurization of Hydrocarbon Materials |
| 3,341,448 Sept. 12, 1967 | Ford, John | British Petroleum | Desulfurization of Hydrocarbons Oxidative Hydro-Treatments |
| 3,565,793 Feb. 23, 1971 | Herbstman, Sheldon | Texaco, Inc. | Desulfurization With a Catalytic Oxidation Step |
| 3,595,778 Jul. 27, 1971 | Smetana, Richard | Texaco, Inc. | Desulfurization Process Including an Oxidation Step |
| 3,719,589 Mar. 6, 1973 | Herbstman, Sheldon | Texaco, Inc. | Asphalt Separation in De-Sulfurization with an Oxidative Step |
| 3,816,301 Jun. 11, 1974 | Sorgenti, Harold | Atlantic Richfield | Process for the Desulfurization of Hydrocarbons |
| 3,945,914 Mar. 23, 1976 | Yoo, Jim | Atlantic Richfield | Process of Sulfur Reduction of an Oxidized Hydrocarbon |

Paris-Marcano received two patents for oxidative desulfurization of petroleum using nitric acid with hydrogen peroxide, U.S. Pat. Nos. 5,017,280 and 5,087,350. Gore of Petrostar received two patents for oxidative desulfurization U.S. Pat. Nos. 6,274,785 and 6,160,193. Cabrerra received a patent for a complex oxidative desulfurization patent assigned to UOP U.S. Pat. No. 6,171,478. Rappas from Unipure received two patents for oxidative desulfurization using performic acid: U.S. Pat. Nos. 6,402,940 and 6,406,616, and Ohsohl of Unipure has received two patents U.S. Pat. Nos. 5,985,137, 5,948,242 for desulfurization of crude oil.

Jeanblanc received a patent, WO/001 5734 for radiative assisted oxidative desulfurization. Sulfur-containing carbonaceous materials are desulfurized by reaction with a mixture of an oxidizing agent and an oxygenated solvent such as diethyl ether under alkaline conditions at a temperature preferably ranging from ambient temperature to about 121° C. and pressure of about 1 to 2 atmospheres. The use of radiation—such as X-ray, infrared, visible microwave, or ultraviolet radiation, alpha, beta or gamma radiation, other atomic radiation emanating from a radioactive material, or ultrasound—facilitates desulfurization. The products of the reaction are a desulfurized carbonaceous material in which the sulfur content is (for example) less than about 1% and separated sulfur compounds.

Yen, U.S. Pat. No. 6,402,939 at Cal Tech received a patent for ultrasonic assisted oxidative desulfurization. Gunnerman has obtained several patents using ultrasonic assistance: U.S. Pat. Nos. 6,500,219, 6,652,592. Stowe disclosed a process to oxidatively desulfurize hydrocarbon oil with ultrasonic assistance, U.S. Pat. No. 5,547,563.

Cullen disclosed in four recent U.S. patent applications assigned to Petrosonics oxidative, reactive, ultrasonic desulfurization technology: Ser. No. 10/411,796 filed Apr. 11, 2003, Sulfone Removal Process; Ser. No. 10/429,369 filed May 5, 2003, Process For Generating and Removing Sulfoxides from Fossil Fuel; Ser. No. 10/431,666 filed May 8, 2003, Treatment of Crude Oil Fractions, Fossil Fuels & Products Thereof with Sonic Energy; and Ser. No. 10/644,255 filed Aug. 20, 2003, entitled Treatment of Crude Oil Fractions, Fossil Fuels & Products Thereof.

Collins, in U.S. Pat. Nos. 5,847,120 and 6,054,580 disclosed long-lived tetraamidomacriocyclic ligand complexes of iron as homogeneous oxidation catalysts to promote peroxide oxidations. The complex provides a stable, long-lived oxidation catalyst or catalyst activator.

Kocal in U.S. Pat. No. 6,277,271 Aug. 21, 2001 assigned to UOP discloses a process for the desulfurization of a hydrocarbonaceous oil. This is a process for the desulfurization of hydrocarbonaceous oil wherein the hydrocarbonaceous oil and a recycle stream containing sulfur-oxidated compounds is contacted with a hydrodesulfurization catalyst in a hydrodesulfurization reaction zone to reduce the sulfur level to a relatively low level and then contacting the resulting hydrocarbonaceous stream from the hydrodesulfurization zone with an oxidizing agent to convert the residual, low level of sulfur compounds into sulfur-oxidated compounds. The residual oxidizing agent is decomposed and the resulting hydrocarbonaceous oil stream containing the sulfur-oxidated compounds is separated to produce a stream containing the sulfur-oxidated compounds and a hydrocarbonaceous oil stream having a reduced concentration of sulfur-oxidated compounds. At least a portion of the sulfur-oxidated compounds is recycled to the hydrodesulfurization reaction zone.

In another UOP assigned patent, Kocal in U.S. Pat. No. 6,368,495 granted Apr. 9, 2002 discloses the removal of sulfur-containing compounds from liquid hydrocarbon streams using hydrogen peroxide on air, with heterogeneous transition metal catalysts. The process more specifically addresses the removal of thiophenes and thiophene derivatives from a number of petroleum fractions, including gasoline, diesel fuel, and kerosene. In the first step of the process, the liquid hydrocarbon is subjected to oxidation conditions in order to oxidize at least some of the thiophene compounds to sulfones. Then, these sulfones can be catalytically decomposed to hydrocarbons (e.g. hydroxybiphenyl) and volatile sulfur compounds (e.g., sulfur dioxide). The hydrocarbon decomposition products remain in the treated liquid as valuable blending components, while the volatile sulfur compounds are easily separable from the treated liquid using well-known techniques such as flash vaporization or distillation.

Cabrera discloses in U.S. Pat. No. 6,174,178 granted Jan. 9, 2001, a new process for the desulfurization of a hydrocarbonaceous oil. A process for the desulfurization of hydrocarbonaceous oil wherein the hydrocarbonaceous oil is contacted with a hydrodesulfurization catalyst in a hydrodesulfurization reaction zone to reduce the sulfur level to a relatively low level and then contacting the resulting hydrocarbonaceous stream from the desulfurization zone with an oxidizing agent to convert the residual, low level of sulfur compounds into sulfur-oxidated compounds. The resulting hydrocarbonaceous oil stream containing the sulfur-oxidated compounds is separated after decomposing any residual oxidizing agent to produce a stream containing the sulfur-oxidated compounds and a hydrocarbonaceous oil stream having a reduced concentration of sulfur-oxidated compounds.

Shum teaches in U.S. Pat. No. 4,772,731 granted Sep. 20, 1988, the epoxidation of olefins with molybdenum dioxo dialkyleneglycolate compositions. Production of novel molybdenum dioxo dialkyleneglycolate compositions, especially adapted for use as catalysts in the epoxidation of olefinic compounds with an organic hydroperoxide, by reaction of molybdenum trioxide with particular dialkylene glycol compounds at specified elevated temperatures while removing water.

Shum discloses in U.S. Pat. No. 5,780,655 granted Jul. 14, 1998, an epoxidation process using an alkylammonium phosphate-stabilized peroxotungstate compound as catalyst. Olefins are selectively converted to epoxides using hydrogen peroxide as oxidant in a single liquid phase reaction system characterized by a liquid phase comprised predominantly of an organic solvent. The reaction is catalyzed by a compound comprised of a phosphate-stabilized peroxotungstate species having a W:P atomic ratio of 2:1. This invention pertains to methods of converting olefins to epoxides in a single liquid phase using hydrogen peroxide and a catalyst in salt or acid form comprising a species corresponding to $(R_4N)_2PW_2O_{13}(OH)$.

Venturello in U.S. Pat. No. 5,274,140 discloses a process for olefin epoxidation by reaction with hydrogen peroxide according to a double phase technique (i.e., a biphasic reaction system containing both an aqueous phase and an organic phase). The catalyst system consists of a first component which is at least one element selected from W, Mo, V or a derivative thereof and a second component which is at least one derivative selected from the derivatives of P and As. The mutual atomic ratio of the catalyst components is between 12 and 0.1, but preferably is between 1.5 and 0.25.

Venturello in U.S. Pat. Nos. 4,562,276 and 4,595,671 describes epoxidation catalysts for olefinic compounds, both in a homogeneous aqueous phase as well as in a heterogeneous phase. The catalysts correspond to the formula $Q_3XW_4O_{24}^{-2}n$ wherein Q represents a cation of an anionic salt, X is either P or As, while n=0, 1, or 2. The atomic ratio of W:P, where X=P, thus must be 4. The use of such compositions in an epoxidation wherein the reactants are maintained in a single substantially organic phase is not disclosed.

Bonsignore in U.S. Pat. No. 5,324,849 teaches a class of compounds based on tungsten and diphosphonic acids which contain active oxygen atoms and cationic groups derived from onium salts. Such compounds are said to catalyze olefin oxidation reactions in double phase reaction systems containing both an organic phase and an aqueous phase. The compounds contain two phosphorus atoms and five tungsten atoms and thus have a W:P atomic ratio of 5:2.

However, the biphasic reaction systems of the type described in the aforementioned patents have a number of disadvantages which limit their usefulness in large scale commercial practice. The need to use a phase transfer agent contributes significantly to the cost of operation. Mass transfer problems are frequently encountered, particularly for relatively volatile olefins such as propylene. Additionally, there are considerable engineering difficulties associated with operating two phase reactors and phase separators. Thus, there is a need to develop active catalysts capable of providing high selectivity to epoxide during operation of a single phase epoxidation process.

SUMMARY OF THE INVENTION

The process of the present invention is directed to the desulfurization of a full-range, hydrotreated diesel oil with an aqueous oxidizing agent in the presence of a catalyst and a co-catalyst, and thereafter selectively removing the oxidized compounds by solvent extraction. Optionally, the foregoing steps are followed by solvent stripping and recovery, and finally by a polishing step.

DETAILED DESCRIPTION OF THE INVENTION

Figure 1:
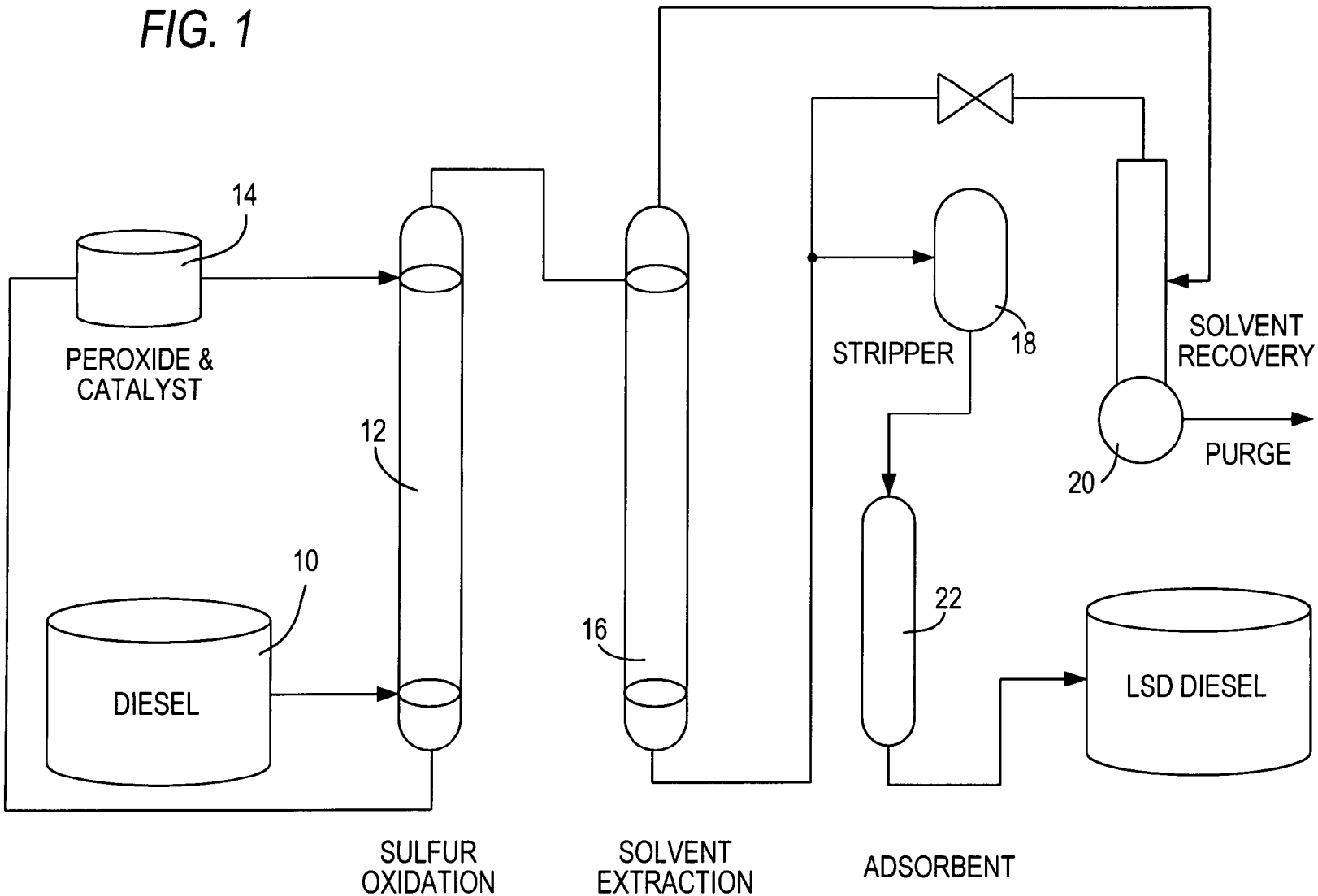
FIG. 1 is a schematic drawing of the process of the present invention.

As can be seen by reference to FIG. 1, hydrotreated diesel in a storage tank 10 is fed into reactor column 12 where it is subjected to continuous oxidation by reaction with an aqueous oxidant and a complex catalyst which is fed into the top of column 12 from a storage tank 14. The aqueous oxidant can be, for example, hydrogen peroxide, sodium hypochlorite or sodium peroxysulfate which is catalyzed by a complex catalyst, followed by a continuous liquid-liquid extraction of the diesel oil by a mixture of water and a polar solvent.

The process serves to desulfurize full range hydrotreated diesel oil with a boiling range of about 240° C. to about 360° C. The process consists of treating the diesel oil in a countercurrent or a stirred tank reactor with an aqueous solution of hydrogen peroxide in the presence of a catalyst and a co-catalyst which is also known as a phase transfer agent. This action results in effecting the oxidation of the sulfur species present in the hydrotreated (HT) diesel at a nominal level of 1000 ppm w/w of total sulfur. The sulfur species present are oxidized to their corresponding sulfoxides, sulfones, sultines, sultones, sulfonates, sulfinates, or even to sulfur dioxide and sulfur trioxide and sulfite and sulfate.

The catalyst employed may be selected from a number of homogeneous or heterogeneous oxidation catalysts including tetraamidomacrocylic iron complexes, tetraalkylammonim polyoxometallates, dioxomolybdenum diglycolate, transition metal tetraphenylporphyrin, transition metal acetylacetonate, bismuthomolybdates, dioxomolybdenum aminodiglycolate, tetraalkylammonim metal sulfotetraphenylporphyrin, molybdotungstic acid phosphonates, as well as many others. These may include quaternary ammonium salts of polyoxometallates, simple metal oxides, Venturello, Campos-Martin, Bressan, Shum, Collins-Horwitz, Beardon, Folin-Denis Reagent, Benedict, Bonsignore, Changwen Hu, Mere Te, Keggin, Dawson, Bearden, and Merox type catalysts. These may include Tetraoctyl-Ammonium Phosphotungstate, Peroxo Molybdotungstic Phosphonate, Phosphomolybdic Acid, Dioxomolybdenum Amino-Diisopropanolate, Triphosphono-Polyperoxotungstate, Bismuthomolybdic Acid, Sodium Sulfophthalocyanine Cobalt Peroxide.

The co-catalysts are employed to enhance and accelerate reactions which though favored thermodynamically, are very slow due to mass transfer issues. They may be anionic cationic and nonionic, with cationic phase transfer agents being preferred. In the present invention, the co-catalyst in each case is the quaternary amine salt used in the synthesis.

These salts do not always have to be pre-formed prior to the reaction, but may be formed in-situ, by adding the transition metal salt or acid and then adding to the same solvent system, for example, aqueous peroxide, the phase transfer agent, such as a quaternary ammonium halide. Representative phase transfer agents are methyltrioctyl-ammonium bromide, cetyltrimethylammonium bromide, tetrabutyl ammonium chloride, tetradecyl pyridium chloride, and tetradecyl pyridinium bromide.

The oxidation reaction takes place in a countercurrent reactor 12, which may be static, stirred, agitated, with oscillating or rotating discs, at a temperature between 50 to 150° C. preferably between about 70 and about 110°. Raffinate from the oxidation which contains residual catalyst, spent or residual oxidant, is recycled to the oxidant-catalyst storage tank 14, where make-up catalyst and oxidant are added.

The concentration of the catalysts may be between about 0.001 and about 1.00, by weight % on oxidant, and preferably between about 0.01 and about 0.10 weight %. Oxidant concentrations may vary between about 1% and about 100%, by weight, but are typically between about 10% and about 50%, and in the case of hydrogen peroxide are preferably between about 15% and about 30%, by weight, in the aqueous phase. Oxidants vary by chemical type, oxidation potential, efficacy, stability, solubility and persons of ordinary skill in the art can establish readily the useful and effective concentrations of oxidant. Oxidants which can be used in the present process include hydrogen peroxide, sodium hypochlorite, sodium or potassium peroxydisulfate or peroxymonosulfate, t-butyl hydroperoxide, perchloric acid, nitric acid, sulfuric acid, performic acid, and mixtures thereof.

The second step of the process involves the removal of the oxidized compounds by contacting the distillate with a selective extraction solvent in column 16. As reported in the literature concerning the ODS process, the liquid-liquid extraction technique using water-soluble polar solvents, such as DMSO, DMF, methanol, and acetonitrile, is usually employed. DMSO and DMF have a high extractability for sulfones but have a high boiling point, which is close to the boiling point of the sulfones, and thus they may not be reused for further extraction based on recovery by distillation. Methanol and acetonitrile are preferred for use as the extraction solvent, since they have relatively low boiling points and are separated easily from the sulfones and other oxidized sulfur species by distillation. When methanol and acetonitrile are contacted with light oil, a large quantity of aromatics is extracted simultaneously with the sulfones. The addition of water, however, suppresses the extractability of the aromatics. Examples of polar solvents include those with high values of the Hildebrand solubility parameter .delta.; liquids with a .delta. higher than about 22 have been successfully used to extract these compounds. Examples of polar liquids, with their Hildebrand values, are shown in the following:

TABLE II

Hildebrand Values of Various Useful Polar Solvents

| Solvent | Hildebrand Value | Solvent | Hildebrand Value |
|---|---|---|---|
| Acetone | 19.7 | DMSO | 26.4 |
| Butyl Cellosolve | 20.2 | n-Butyl alcohol | 28.7 |
| Carbon disulfide | 20.5 | Acetonitrile | 30.0 |
| Pyridine | 21.7 | Methanol | 29.7 |
| Cellosolve | 21.9 | Propylene glycol | 30.7 |
| DMF | 24.7 | Ethylene Glycol | 34.9 |
| n-Propanol | 24.9 | Glycerol | 36.2 |
| Ethanol | 26.2 | Water | 48.0 |

However, as will be obvious to those of ordinary skill in the art, mere polarity considerations are insufficient to define successful extraction solvents. Methanol, for instance, has sufficient polarity, but its density, 0.79 g/cc, is about the same as that of a typical light oil, making separations very difficult. Other properties to consider include boiling point, freezing point, viscosity, and surface tension. Surprisingly, the combination of the properties exhibited by DMSO make it an excellent solvent for extracting oxidized sulfur and nitrogen compounds from liquid light oil, but unfortunately it contains a large proportion of sulfur. Heteroatom solvents containing nitrogen, phosphorous, and sulfur must be very volatile to ensure stripping of the solvent out of the diesel oil. The preferred solvents in this process are acetonitrile and methanol, due to their polarity, volatility, and low cost.

In the second stage or step, the oxidized sulfur compounds are extracted in countercurrent extractor 16 of the Karr, Scheibel, or other configuration of countercurrent or stirred tank extractor to remove the oxidized sulfur compounds from the diesel oil. The extraction phase is composed of an aqueous solution containing from about 10 to about 30% water in a polar organic solvent, including acetonitrile, methanol, or other solvent. Therefore, the solvents should be sufficiently polar to be selective for polar compounds in the process of extraction.

In a third stage of the process a stripper column is employed to remove traces of the solvent from the diesel oil. The solvent is recovered and sent to the solvent recovery fractionator 20.

In a fourth stage of the process, the extraction-rich solvent is recovered in a stripper recovery flash evaporator (not shown). Bottoms from the evaporator are purged to a sulfone storage tank to be sold as petrochemical intermediates, or added to fuel oil or crude oil.

In a fifth stage of this process, the diesel oil is passed through an adsorbent polishing column which removes the last traces of sulfur to below 10 ppm w/w from the diesel oil. Many adsorbents can be used for this purpose, including activated carbon, silica gel, alumina and other inorganic adsorbents. In a preferred embodiment of this invention, a new adsorbent comprised of polar polymers coated onto inert but high surface area supports, such as silica gel, alumina, and activated carbon are utilized. These polymers include, among other candidates, polysulfones, polyacrylonitrile, polystyrene, polyester terephthalate, polyurethane, and other polymers which demonstrate affinity for oxidized sulfur species. The advantage of using the polymer coated onto the support is that the adsorption and desorbtion processes are rapid and reversible, and the adsorbates are easily recovered, and the column is easily regenerated by extraction with a suitable solvent and dried.

EXAMPLES 1-7

Insofar as the catalyst preparations and oxidations disclosed in the following examples are concerned, guidance was provided by the following references for their respective examples.

1. Venturello, Carlo, et al., U.S. Pat. No. 4,562,276, Peroxide Composition Based on Tungsten and Phosphorus or Arsenic and Processes and Uses Relative Thereto, Dec. 31, 1985.
2. Bonsignore, Stefanio, et al, U.S. Pat. No. 5,324,849 Class of Peroxy Compounds Based on Tungsten and Diphosphonic Acids and Process for Obtaining Them, Jun. 28, 1994.
3. Te, Mure, et al, Oxidation Reactivities of Dibenzothiophenes in Polyoxymetalate/$H_2O_2$ and Formic Acid/$H_2O_2$ Systems, Applied Catalysis A: General 219 (2001) 267-280.
4. Shum, Wilfred, et al, Production of Molybdenum Dioxo Dialkyleneglycolate Compositions for Epoxidation of Olefins, U.S. Pat. No. 4,607,113, Aug. 19, 1986.
5. Campos-Martin, J. M., et al, Highly Efficient Deep Desulfurization of Fuels by Chemical Oxidation, Green Chemistry, 2004, 6, 556-562.
6. Hu, Changwen, Catalysis by Heteropoly Compounds XXII. Reactions of Esters and Esterifications Catalyzed by Heteropolyacids in a Homogeneous Liquid Phase, Journal of Catalysis 143, 437-448 (1993).
7. Bressan, Mario, et al, Oxidation of Dibenzothiophene by Hydrogen Peroxide or Monopersulfate and Metal-Sulfophthalocyanine Catalysts, New Journal of Chemistry, 2003, 27, 989-993.

Example 1

Tetraoctyl-Ammonium Phosphotungstate

Carlo Venturello Catalyst $\{(C_8H_{17})_4N\}_3PW_4O_{24}$FW 2550.99)

A. Preparation of Venturello Catalyst: Sodium tungstate, $Na_2WO_4.2H_2O$ (3.30 g, 10 mmol) was weigned to a 250 ml beaker and 7 ml of 30% aqueous hydrogen peroxide, $H_2O_2$ was added and stirred at 25° C. until a colorless solution was obtained. To this solution, was added 1.0 ml 85% phosphoric acid $H_3PO_4$ and the whole was diluted to 50 ml with water. To the resultant solution, 2.5 g of tetraoctylammonium chloride (Aldrich) in methylene chloride was added dropwise with stirring over about 2 min. Stirring was continued for an additional 15 min. The organic phase was then separated, filtered, and evaporated at room temperature overnite to give 3.5 g of a colorless syrup.

B. Oxidation of Arabian Light Gas Oil: A 100-ml sample of full range (FR) hydrotreated (HT) Arabian Light Gas Oil (ALGO) containing 910 ppm w/v of total sulfur was heated to 85° C. with stirring on a stirring hot plate. A 50-ml portion of 15% w/w hydrogen peroxide in water was added then 50 mg of catalyst A. Preparation of Venturello Catalyst, tris(cetyltrimethylammonium) phophotungstate (Venturello Catalyst) was added. The reaction was continued for 15 minutes then the reactants were cooled and poured into a 250-ml separatory funnel. The aqueous peroxide lower phase was withdrawn and discarded. A sample of the oil phase was analyzed by gas chromatography with a Sievers Sulfur Chemiluminescence Detector (GC-SCD), and compared with a sample of the original FR HT ALGO. The chromatogram showed the presence of apparently the same amount of sulfur, but the sulfur peaks were displaced until later in the chromatogram, indicating the formation of sulfones. Sulfur analysis showed the oxidized sample to contain 880 ppm w/v sulfur, allowing for analytical error, indicating no removal of the sulfur.

C. Batch Extraction Of Oxidized Oil: The 100 ml sample of oil phase prepared in B. Oxidation of Arabian Light Gas Oil, was extracted twice with 50 ml portions of acetonitrile containing 10% v/v distilled water. After the second extraction, 98 ml of oil was recovered, and analyzed for total sulfur and was found to contain 60 ppm sulfur w/v. The oil sample was analyzed by GC-SCD and the original and oxidized sulfur peaks were practically all removed. The two extracts were combined and were evaporated overnight to a dry oil, and was then analyzed by GCMS and GC-SCD. The GC-SCD indicated the presence of the alkylbenzothiophene-dioxides and alkyldibenzothiophene-dioxides that were present originally in the oxidate oil. GCMS results indicated the presence of methyl, dimethyl, trimethyl, and tetramethyl benzothiophene sulfones and dibenzothiophene sulfones.

D. Countercurrent Extraction Of Oxidized Oil: A 100-ml sample of full range (FR) Hydrotreated (HT) Arabian Light Gas Oil (ALGO) containing 910 ppm w/v of total sulfur was oxidized as in B. Oxidation of Arabian Light Gas Oil, but was not extracted. The 100 ml sample of oxidized oil containing approximately 900 ppm w/v sulfur as sulfones, was transferred to a 2.5 cm by 75 cm fritted countercurrent extraction apparatus containing 50 cm of glass beads of 3 mm diameter. A Hitachi L2000 laboratory pump was used to pump 150 ml of acetonitrile:water 90:10 v/v at 10 ml/min upward through the fritt and through the oxidized oil. After countercurrent extraction with the mixed polar solvent, the oil was withdrawn from the extraction apparatus and analyzed by GC-SCD and for total sulfur. No sulfur peaks were detected in the extracted oil, and total sulfur analysis gave a value of 25 ppm w/v.

E. Polishing Of Extracted Oxidized Oil With Solid Phase Adsorbant Media: A 100-ml sample of full range (FR) Hydrotreated (HT) Arabian Light Gas Oil (ALGO) containing 910 ppm w/w of total sulfur was oxidized and extracted exactly as in Example B. and C. above. The sample of oxidized and extracted oil was passed through a 2.5 cm diameter by 50 cm high fritted chromatography column containing 10 grams of Millipore Cyano Bonded solid phase extraction media. The effluent from the column was analyzed by GC-SCD and found to contain no detectable sulfur peaks. Sulfur analysis by Antek total sulfur gave a result of 8 ppm w/v.

F. Polishing Oxidized Extracted Oil by Alumina: The 100-ml sample of oxidized and extracted oil prepared in D. Countercurrent Extraction Of Oxidized Oil, was passed through a 2.5 cm diameter by 50 cm height fritted chromatography column containing 10 grams of Davidson Alumina. The effluent from the column was analyzed by GC-SCD and found to contain no detectable sulfur peaks. Sulfur analysis by Antek total sulfur gave a result of 5 ppm w/v.

Example 2

Molybdotungstic Phosphonate

Stefanio Bonsignore Catalyst $Mo_2W_7O_{30}.2N(CH_2PO)_3$ (FW 2217.75)

A. Preparation of Bonsignore Catalyst: Weighed 3.54 grams $(NH_4)_6Mo_7O_{24}.4H_2O$ (FW 1235.86) 23.10 grams $Na_2WO_4.2H_2O$ (FW 329.86) into 250 ml beaker and added 100 ml distilled water. The solution contains 20 meq of molybdenum and 70 meq of tungsten. Stirred vigorously for 15 minutes until the solution became clear and colorless. Transferred 3 ml of the solution to a 20 ml vial. Added 1.0 ml of 30% hydrogen peroxide and mixed until a wine-red color developed. Added 2.00 ml of a 30% (1.0 M) solution (2.0 millimole) of amino-tris-methylenephosphonic acid (ATMP) $N(CH_2PO_3H_2)_3$ (MW 299.05). The solution quickly turned greenish-yellow.

B. Oxidation and Analysis of Oil: Prepared 100 ml of full range hydrotreated straight run diesel in a 400 ml beaker. Added 50 ml of 15% hydrogen peroxide and began heating and stirring. Added 25 mg of Tetradecyl Ammonium Bromide (TDAB) phase transfer catalyst. Added the 5.0 ml of prepared peroxo-molybdotungstate trisphosphonate catalyst into the oil-water-peroxide mixture. Continued heating to 80° C., then held between 80-100° C. for 40 minutes.

Oxidate mixture was cooled and transferred to a 250 ml separatory funnel. The lower aqueous layer was separated and discarded, and the oil layer was transferred to a 200 ml polyethylene bottle. A sample of the oil was analyzed by Sievers GC-SCD. All of the sulfur peaks were shifted to the sulfone region of the chromatogram. Apparent conversion is 100%.

Example 3

Dodecamolybdophosphosphoric Acid

Mere Te Catalyst Phosphomolybdic Acid $H_3PO_4Mo_{12}O_{36}.XH_2O$ (FW1825.25)

A. Preparation of Catalyst: Two grams of molybdic acid (Fisher $MoO_3$ 89.1%) was weighed into a 400 ml beaker. 40 ml distilled water was added. NaOH pellets 0.25 g were added and the mixture was stirred until all dissolved. Two grams of ammonium para-molybdate $(NH_4)_6Mo_7O_{24}.4H_2O$) was added and swirled with NaOH pellets 0.5 g added. This mixture was stirred for 10 minutes until all dissolved. 5.0 ml of 85% phosphoric acid was added and stirring continued. Then 3.0 ml of concentrated nitric acid was added, with continuous stirring. The solution gave a very faint yellow tinge.

B. Oxidation and Analysis of Oil: 100 ml of Hydrotreated Diesel was added to a 400 ml beaker. 50 ml of 15% hydrogen peroxide was added. Two ml of the catalyst solution above was added with stirring as the sample was heated. 50 mg of hexadecylpyridinium chloride (Aldrich) was added, and the solution was heated to 80° C. and held between 80-100° C. with vigorous stirring for 30 minutes. The sample was cooled and transferred to a 250 ml separatory funnel, and the lower aqueous layer was removed and discarded. The oil was transferred to a 200 ml polyethylene bottle, and was analyzed by Sievers GC-SCD. Approximately 20% of the sulfur peaks shifted to later retention times, indicating oxidation of benzothiophenes and dibenzothiophenes to their respective sulfones.

Example 4

Dioxomolybdenium Amino-Diisopropanolate

Wilfred Shum Catalyst $MoO_2NH(CHCH_3CH_2O)_2$ (FW 763.03)

A. Catalyst Preparation: Ammonium paramolybdate 17.7 grams $(NH_4)_6Mo_7O_{24}.4H_2O$ (FW 1235.86) was weighed into a 400 ml beaker and 125 ml distilled water was added. 40 ml of aqueous 40% diisopropanol amine (technical grade) was added with stirring. The solution was heated to 135° C. with stirring. A slow stream of air was bubbled through the solution as it was heated for eight hours.

B. Oxidation and Analysis of Oil: 100 ml of Hydrotreated Diesel was added to a 400 ml beaker. 50 ml of 15% hydrogen peroxide was added. Two ml of the catalyst solution above was added with stirring as the sample was heated. 50 mg of tetra-octyl ammonium bromide was added, and the solution was heated to 80° C. and held between 80-100° C. with vigorous stirring for 30 minutes. The sample was cooled and transferred to a 250 ml separatory funnel, and the lower aqueous layer was removed and discarded. The oil was transferred to a 200 ml polyethylene bottle, and was analyzed by Sievers GC-SCD. Approximately 10% of the sulfur peaks shifted to later retention times, indicating oxidation of benzothiophenes and dibenzothiophenes to their respective sulfones.

Example 5

Triphosphono-Polyperoxotungstate

J. M. Campos-Martin Catalyst $N(CH_2PO)_3$ $(WO_5)_9$ (FW 2571.54)

A. Preparation of Catalyst: Sodium Tungstate $Na_2WO_4.2H_2O$ (3.0 grams) was dissolved in 10 ml of 30% hydrogen peroxide, to form a bright yellow solution. Three ml of a 30% solution of amino (tris) methylenephosphonic $(N(CH_2PO_3H_2)_3$ acid were added. The solution turned colorless immediately. This solution was diluted to 30 ml with distilled water.

B. Oxidation and Analysis of Oil: 100 ml of Hydrotreated Diesel was added to a 400 ml beaker. 50 ml of 15% hydrogen peroxide was added. Two ml of the catalyst solution above was added with stirring as the sample was heated. 50 mg of hexadecyltrimethyl ammonium bromide was added, and the solution was heated to 80° C. and held between 80-100° C. with vigorous stirring for 30 minutes. The sample was cooled and transferred to a 250 ml separatory funnel, and the lower aqueous layer was removed and discarded.

The oil was transferred to a 200 ml polyethylene bottle, and was analyzed by Sievers GC-SCD. Approximately 90% of the sulfur peaks shifted to later retention times, indicating oxidation of benzothiophenes and dibenzothiophenes to their respective sulfones.

Example 6

Bismuthomolybdic Acid

Changwen Hu $H_5BiMo_{12}O_{40}.4H_2O$ (FW 2077.34)

A. Preparation of Catalyst: Bismuth nitrate 2.0 grams $Bi(NO_3)_2.2H_2O$ was dissolved in 50 ml of distilled water in a 250 ml beaker Concentrated nitric acid was added dropwise until the solution was complete. Ammonium paramolybdate $(NH_4)_6Mo_7O_{24}.4H_2O$ 25.0 grams was weighed into a 400 ml beaker and was dissolved in 150 ml distilled water with vigorous stirring. A white precipitate formed immediately and was aged at 50° C. for 6 hours. The product was filtered, washed with distilled water, then dried overnite. The sample was broken up to powder and mixed, then calcined for 12 hours at 450° C.

B. Oxidation and Analysis of Oil: 100 ml of Hydrotreated Diesel was added to a 400 ml beaker. 50 ml of 15% hydrogen peroxide was added. 100 mg of the catalyst was added with stirring as the sample was heated. 50 mg of tetraoctyl ammonium bromide was added, and the solution was heated to 80° C. and held between 80-100° C. with vigorous stirring for 30 minutes. The sample was cooled and transferred to a 250 ml separatory funnel, and the lower aqueous layer was removed and discarded. The oil was transferred to a 200 ml polyethylene bottle, and was analyzed by Sievers GC-SCD. At least 95% of the sulfur peaks shifted to later retention times, indicating oxidation of benzothiophenes and dibenzothiophenes to their respective sulfones.

Example 7

Sodium Sulfophthalocyanine Cobalt Peroxide

Mario Bressan Catalyst $Na_4C_{32}H_{12}N_8S_4O_{12}Co(II)O_2$ (FW 1011.64)

A. Preparation of Catalyst: Commercial UOP Cobalt Sulfophthalocyanine (Merox Catalyst) 0.50 g was dissolved in 100 ml 10% NaOH to prepare a 5000 ppm stock catalyst solution. 4.0 ml of the catalyst solution was added to 36 ml of an aqueous solution 3.8625% $KHSO_5$ potassium monopersulfate (0.25 Molar) Mallinkrodt. The catalyst solution was placed in a vial until used for oxidation. Final concentrations of the catalyst solution are 500 ppm of cobalt sulfophthalocyanine and 0.225M in potassium monopersulfate.

B. Oxidation and Analysis of Oil: 100 ml of Hydrotreated Diesel was added to a 500-ml Erlenmeyer flask, and a condenser was fitted to the flask. 40 ml of the catalyst-monopersulfate solution was added. 60 ml of acetonitrile was added with stirring as the sample was heated. The mixture was heated to 83° C. and held between 80-100° C. with total reflux and vigorous stirring for 3 hours. The sample was cooled at 5° C. for two hours, and the two phases were separated. The contents of the Erlenmeyer flask were transferred to a 250-ml separatory funnel, and the lower aqueous-acetonitrile layer was removed and discarded. The oil was transferred to a 200-ml polyethylene bottle, and was analyzed by Sievers GC-SCD. Approximately 50% of the sulfur peaks were removed from the oil and some were shifted to later retention times, indicating oxidation of benzothiophenes and dibenzothiophenes to their respective sulfones. Approximately half of the sulfur was removed from the oil and transferred to the acetonitrile-water phase.

What is claimed is:

1. A process for reducing the sulfur content of diesel fuel comprising the steps of:

a. contacting a diesel fuel containing sulfur compounds in a reactor with an oxidant selected from the group consisting of sulfuric acid, peracetic acid, hydrogen peroxide, sodium hypochlorite, perchloric acid, nitric acid, sodium or potassium peroxidisulfate or peroxymonosulfate, and mixtures thereof, in the presence of a homogeneous or heterogeneous oxidation catalyst selected from the group consisting of $\{(C_8H_{17})_4N\}_3PW_4O_{24}$, $Mo_2W_7O_{30}.2N(CH_2PO)_3$, $MoO_2NH(CHCH_3CH_2O)_2$, $N(CH_2PO)_3(WO_5)_9$, $H_5BiMo_{12}O_{40}.4H_2O$, and $Na_4C_{32}H_{12}N_8S_4O_{12}Co(II)O_2$, at a temperature in the range of from about 50° C. to about 150° C. for a period of time sufficient to oxidize the sulfur compounds; and b. removing the oxidized sulfur compounds from the diesel fuel by liquid-liquid countercurrent extraction with a water-soluble polar solvent.

2. The process according to claim 1, including the steps of:

a. stripping the solvent from the diesel fuel; and b. polishing the diesel fuel by passing it through an adsorbent to remove the remaining sulfur compounds.

3. The process according to claim 1, wherein the reactor is a countercurrent reactor.

4. The process according to claim 1, wherein the reactor is stirred, agitated, oscillated, or static.

5. The process according to claim 1, wherein the solvent is selected from the group consisting of aqueous solutions of acetonitrile and methanol.

6. The process according to claim 2, wherein the polishing is effected by an adsorbent bed consisting of polar organic groups coated on or bound to a support selected from the group consisting of silica, alumina, and carbon.

7. The process of claim 5, wherein the solvent contains from about 10% to 30% water by volume.

8. The process of claim 7, wherein the solvent contains 10% water by volume.

9. The process of claim 1, wherein the concentration of sulfur in the treated diesel fuel is reduced to less than 10 ppm by weight.

10. A process for reducing the sulfur content of diesel fuel containing sulfur compounds comprising:

a. introducing an aqueous oxidant and a heterogeneous or homogenous catalyst selected from the group consisting of $\{(C_8H_{17})_4N\}_3PW_4O_{24}$, $Mo_2W_7O_{30}.2N(CH_2PO)_3$, $.XH_2O$, $MoO_2NH(CHCH_3CH_2O)_2$, $N(CH_2PO)_3(WO_5)_9$, $H_5BiMo_{12}O_{40}.4H_2O$, and $Na_4C_{32}H_{12}N_8S_4O_{12}Co(II)O_2$, into the top of a reactor column;

b. contacting the oxidant and catalyst in countercurrent flow in the reactor with a diesel fuel boiling in the range of from about 240° C. to about 360° C.;

c. continuously oxidizing the sulfur compounds in the diesel oil;

d. continuously extracting oxidized compounds from the diesel oil produced in the reactor by contact with an aqueous solution of a polar solvent in a column;

e. removing traces of aqueous solution from the diesel fuel in a stripper column;

f. recovering the aqueous solution; and g. adsorbing remaining sulfur compounds from the diesel fuel with an absorbent selected from the group consisting of activated carbon, silica gel and alumina.

11. The process of claim 10, wherein the aqueous solution is selected from the group consisting of aqueous methanol and aqueous acetonitrile.

12. The process according to claim 10, wherein the concentration of sulfur compounds in the diesel fuel is reduced to less than 10 ppm by weight.

13. The process of claim 6 in which the solid support is coated with polar polymers selected from the group consisting of polysulfone, polyacrylonitrite, polystyrene, polyester terephthlate and polyurethane.

14. The process of claim 1 in which the diesel fuel to be treated is a low sulfur hydrotreated diesel containing about 1000 ppm by weight of sulfur.

15. The process of claim 1, wherein the oxidation catalyst is $\{(C_8H_{17})_4N\}_3PW_4O_{24}$.

16. The process of claim 1, wherein the oxidation catalyst is $Mo_2W_7O_{30}.2N(CH_2PO)_3$.

17. The process of claim 1, wherein the oxidation catalyst is $MoO_2NH(CHCH_3CH_2O)_2$.

18. The process of claim 1, wherein the oxidation catalyst is $N(CH_2PO)_3(WO_5)_9$.

19. The process of claim 1, wherein the oxidation catalyst is $H_5BiMo_{12}O_{40}.4H_2O$.

20. The process of claim 1, wherein the oxidation catalyst is $Na_4C_{32}H_{12}N_8S_4O_{12}Co(II)O_2$.

21. The process of claim 10, wherein the oxidation catalyst is $\{(C_8H_{17})_4N\}_3PW_4O_{24}$.

22. The process of claim 10, wherein the oxidation catalyst is $Mo_2W_7O_{30}.2N(CH_2PO)_3$.

23. The process of claim 10, wherein the oxidation catalyst is $MoO_2NH(CHCH_3CH_2O)_2$.

24. The process of claim 10, wherein the oxidation catalyst is $N(CH_2PO)_3(WO_5)_9$.

25. The process of claim 10, wherein the oxidation catalyst is $H_5BiMo_{12}O_{40}.4H_2O$.

26. The process of claim 10, wherein the oxidation catalyst is $Na_4C_{32}H_{12}N_8S_4O_{12}Co(II)O_2$.

27. The process of claim 3, further comprising introducing oxidant and catalyst into the countercurrent reactor from an oxidant-catalyst storage tank, and recycling residual catalyst and spent or residual oxidant from the countercurrent reactor to the oxidant-catalyst storage tank.

28. The process of claim 27, further comprising adding make-up catalyst and/or oxidant to the oxidant-catalyst storage tank.

29. The process of claim 10, further comprising introducing oxidant and catalyst into the countercurrent reactor from an oxidant-catalyst storage tank, and recycling residual catalyst and spent or residual oxidant from the countercurrent reactor to the oxidant-catalyst storage tank.

30. The process of claim 29, further comprising adding make-up catalyst and/or oxidant into the oxidant-catalyst storage tank.

* * * * *